US007635310B2

(12) United States Patent
Keough

(10) Patent No.: US 7,635,310 B2
(45) Date of Patent: Dec. 22, 2009

(54) WEIGHTED GOLF CLUB GRIPS AND SHAFTS

(76) Inventor: David B. Keough, 2973 E. Dimple Dell La., Sandy, UT (US) 84092

( * ) Notice: Subject to any disclaimer, the term of this patent is extended or adjusted under 35 U.S.C. 154(b) by 11 days.

(21) Appl. No.: 11/941,676

(22) Filed: Nov. 16, 2007

(65) Prior Publication Data

US 2009/0131194 A1 May 21, 2009

(51) Int. Cl.
*A63B 53/14* (2006.01)

(52) U.S. Cl. ..... 473/297

(58) Field of Classification Search ..... 473/300–303, 473/297, 549–552, 568; D21/756; D8/DIG. 6, D8/DIG. 7, DIG. 8; 74/551.9; 81/489, 490, 81/492; 16/421, 430, DIG. 12, DIG. 18, 16/DIG. 19, DIG. 24; 280/821
See application file for complete search history.

(56) References Cited

U.S. PATENT DOCUMENTS 1,453,503 A * 5/1923 Holmes ..... 473/336
2,820,638 A 1/1958 Morrison
D221,446 S 8/1971 Cook
3,606,327 A * 9/1971 Gorman ..... 473/297
3,941,390 A 3/1976 Hussey
3,954,265 A 5/1976 Taylor
4,272,077 A 6/1981 Spivey
4,690,407 A 9/1987 Reisner
4,746,120 A 5/1988 Mockvak
4,852,879 A 8/1989 Collins
5,078,398 A 1/1992 Reed et al.
5,226,654 A 7/1993 Solheim
5,244,209 A 9/1993 Benzel
5,290,035 A 3/1994 Hannon et al.
5,417,108 A * 5/1995 Chastonay ..... 73/65.03
5,544,883 A 8/1996 Meyer
5,569,098 A 10/1996 Klein
6,511,386 B1 * 1/2003 Cacicedo ..... 473/300
6,776,727 B1 * 8/2004 Engdahl ..... 473/340
7,267,619 B1 9/2007 Pettis
2003/0084756 A1 * 5/2003 Schroder et al. ..... 81/20
2003/0186759 A1 10/2003 Buchanan
2007/0219015 A1 * 9/2007 Gazeley ..... 473/300
2007/0243945 A1 * 10/2007 Hoium et al. ..... 473/285
2008/0009363 A1 * 1/2008 Solodovnick ..... 473/297

* cited by examiner

*Primary Examiner*—Stephen L. Blau

(57) ABSTRACT

A weighted golf club grip for a golf club includes a hollow grip member that defines a first longitudinal channel for receiving a shaft and a second longitudinal channel disposed within a wall of the hollow grip member for receiving a plurality of weighted members disposed within the second channel. An end cap is attached to the end of the grip member. The weighted grip is capable of face-balancing the head of a putter and square-balancing the face of other golf clubs to an open, square, or closed position.

1 Claim, 16 Drawing Sheets

WEIGHTED GOLF CLUB GRIPS AND SHAFTS

FIELD OF THE INVENTION

The present invention relates generally to golf clubs, and more particular to weighted grips and shafts for golf clubs.

BACKGROUND OF THE INVENTION

It has been a general principle in the art of club making to place the weight of the club primarily at the head and to lighten the shaft and grip sections to place the bulk of the weight within the head of the club. In the article "Bubbling Over," Golf World, March 1995, an account of the development of the Taylor Made Bubble shaft was provided. In that article, it was indicated that part of the design of the club was to keep the upper part of the club at the grip end and the shaft as light as possible—some 40% lighter than standard to allow more mass to be placed at the club head to create a high moment of inertia while not increasing the overall weight of the club. While this design philosophy may be true for drivers, woods, hybrids and irons where a low overall inertia will contribute to a faster swing speed, in putting, a slower more controlled stroke, preferably a linear stroke, is desired. Thus, a putter with a weighted or high inertia grip is more likely to contribute to a slower more controlled putting stroke.

Modern theories of putting also emphasize the use of substantially large or over-size grips. U.S. Pat. No. 4,746,120 (Mockvak) discloses a putter having a grip diameter of at least 2.5 inches (63.5 mm) and discusses how this promotes balance and stability of the muscles used in putting. U.S. Pat. No. 4,272,077 (Spivey) discloses a putter having a grip between 1.25 and 1.87 inches (31.8 and 47.7 mm) and discusses how putter grips of these dimensions relax the hands and prevent jerking of unbalanced muscles. U.S. Pat. No. 5,569,098 (Klein) contains an excellent discussion of the mechanics of putting and how this is facilitated by over-size grips. Among other things, this patent teaches that the large diameter grip greatly reduces excessive wrist action and promotes the use of a looser grip which improves kinesthetic feedback thus enhancing the tactile sensitivity of the golfer's hands. Accordingly, the reaction forces acting on the club when the ball is struck can be better felt.

In the book "The Search for the Perfect Swing", published 1968, page 135, it is postulated that an optimum putter design can be achieved by redistributing the weight to the sides of the putter head. This design philosophy is discussed in U.S. Pat. No. 3,941,390 (Hussey) which teaches that to achieve a maximized moment of inertia weighting material should be placed as far as possible from the neutral axis under consideration. In addition, there has been a trend in the design of putter heads to create excessively weighted and oversized putter heads in order to increase the mass of the putter head to increase the moment of inertia of such putter heads and to allow for the placement of weighting material away from the neutral axis of the putter.

"Face-balanced" putters are well known and have been available for many years. Such putters are described, for example, in U.S. Pat. Nos. 5,544,883, 5,290,035, 5,226,654, 5,078,398, 4,852,879, 3,954,265, 2,820,638, and U.S. Pat No. Des. 221,446. In a face-balanced putter the axis of the shaft intersects the center of gravity of the putter head or intersects a line which extends through the center of gravity perpendicularly to the face. As such, face-balanced putters require a specific shaft position relative to the putter head in order to face-balance the putter. Often times, however, it is desirable in putter construction to attach the shaft closer to the heel of the putter. Such putters, however, result in a non-face-balanced design.

During a putting stroke, it is crucial for the golfer to cause the putter face to squarely strike the back of the ball and with a directional force that is parallel to the target line. Any deviation in the squareness of the putter face relative to the target line and/or the directional force from the putter face to the back of a golf ball will cause the golf ball to roll off line from the intended target line. That is, if the force applied to the back of a golf ball is not parallel to the target line, the ball will begin rolling at some angle relative to the intended target line. Likewise, if the face of the putter is not square at impact, even if the force applied by the putter is parallel to the target line, the ball will roll off line. As such, there have been a myriad of putter head designs intended to help the golfer impart a force to the back of the ball that is parallel to the target line and in a manner in which the putter face is perpendicular or square to the target line and the focus of most putter designs have been directed to the head itself.

It is also known in the art to provide a weighted element to the grip of a golf club as disclosed in U.S. Pat. No. 4,690,407, the entirety of which is incorporated herein by this reference. Likewise, it is known in the art to provide a weighted hollow cylindrical plug inserted into the golf shaft as disclosed in U.S. Pat. No. 5,244,209, the entirety of which is incorporated by this reference. Neither of these patents, however, allow for both symmetrical and asymmetrical weighting of a golf club.

Accordingly, it would be advantageous to provide a golf grip that provides the ability to face-balance a preexisting putter or square-balance an iron, wood or hybrid golf club without having to modify the golf club head or shaft. In the case of a putter, it would also be advantageous to provide a weighted putter grip that is oversized to provide an oversized putter grip that is easy to manufacture, easy to install and is customizable to provide a putter grip of various weight. It would be a further advantage to provide a weighted golf grip that allows for adjustment of the amount of weight. It would also be an advantage to provide a weighted grip that is of the same size and external configuration as a traditional golf grip.

SUMMARY OF THE INVENTION

Accordingly, the present invention is comprised of a grip for a putter, driver or iron golf club. The grip is comprised of a hollow grip member having a longitudinal bore or channel extending therethrough for receiving the grip end of a putter shaft. The hollow grip member has an outer surface configured for gripping by a user and an inner surface defined by the longitudinal bore. The hollow grip member includes a second longitudinal channel disposed within the wall of the hollow grip member between the outer and inner surfaces. At least one weighted member is disposed within the second channel with the weighted member providing weighting to at least one side of the hollow grip member for face-balancing the head of the putter.

In one embodiment, the outer surface of the grip member has a first outer contour portion that is substantially circular in diameter and a second outer contour portion that is elliptical.

In another embodiment, the putter grip has at least one channel that is longitudinally oriented and that has an opening at a proximal end of the hollow grip member for receiving the weighted member.

In yet another embodiment, the putter grip includes a plurality of weighted members.

In still another embodiment, the putter grip comprises an elongate rod having a first threaded end and a head attached to a second end. The first threaded end is configured for threading into an internally threaded fastener disposed within the second channel. The weights have apertures for being disposed around the rod and are secured relative to the rod.

In yet another embodiment, the putter grip includes an end cap configured for attachment to a proximal end of the hollow grip member. The end cap has at least one magnet disposed therein for magnetically holding a ball marker to the end cap.

In another embodiment, the putter grip includes a recess formed in a top outer surface of the end cap for receiving a ball marker therein.

In yet another embodiment, the second channel containing the weights forms a friction fit with the weights to hold them securely within.

In another embodiment, the weighted members have a weight sufficient to face balance the head of a putter relative to the shaft of which the hollow grip member is attached.

In still another embodiment, the hollow grip member has an oblong cross-sectional shape with the weighted members disposed along the widest part of the grip member, the widest part of the grip member being oriented substantially parallel to a face of the putter.

In yet another embodiment, the shaft of a golf club is weighted.

DESCRIPTION OF THE DRAWINGS

It will be appreciated by those of ordinary skill in the art that the various drawings are for illustrative purposes only. The nature of the present invention, as well as various embodiments of the present invention, may be more clearly understood by reference to the following detailed description of the invention, to the appended claims and to the several drawings.

DETAILED DESCRIPTION OF THE ILLUSTRATED EMBODIMENTS

The present invention relates to grips for golf clubs. It will be appreciated by those skilled in the art that the embodiments herein described, while illustrating certain embodiments, are not intended to so limit the invention or the scope of the appended claims. Those skilled in the art will also understand that various combinations or modifications of the embodiments presented herein can be made without departing from the scope of the invention. All such alternate embodiments are within the scope of the present invention. Similarly, while the drawings depict illustrative embodiments of the devices and components in accordance with the present invention and illustrate the principles upon which the device is based, they are only illustrative and any modification of the invented features presented here are to be considered within the scope of this invention.

Figure 1:
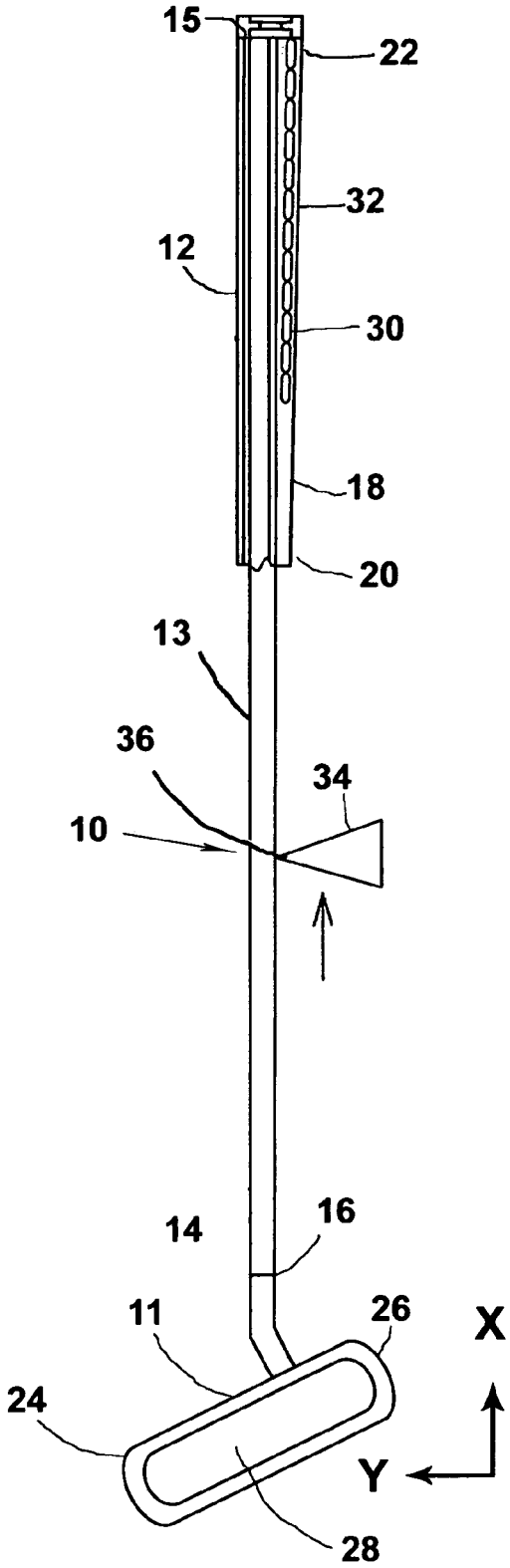
FIG. 1 is a partial cross-sectional side view of an embodiment of putter grip in accordance with the principles of the present invention attached to a putter.

In FIG. 1 there is shown a putter 10 having a putter grip 12 in accordance with the present invention attached thereto. The putter 10 comprises a putter head 11 and a shaft 13 connecting to the head 11 at a distal end 16 and having the grip 12 attached along a length of the shaft 13 from the proximal end 15. Shaft 13 is a tubular hollow tapered shaft and may be of any configuration and material and may be connected to the head 11 by means of a hosel 14. Hosel 14 may be hollow. Grip 12 comprises an elongate hollow member 18 having a generally tubular configuration and having a distal end 20 and a proximal end 22. The grip 12 may be attached to the shaft 13 by any means customary in the art, such as by adhesive and/or adhesive tape application.

As further illustrated in FIG. 1, the putter head 11 has a toe portion 24, a heel portion 26 and a face 28 that defines the ball striking surface. The putter head 11 and shaft 13 are of a conventional putter configuration and may comprise a preexisting putter with the conventional grip (not shown) removed. The putter grip 12 includes a plurality of weight members 30 disposed therein. The weight members 30 are disposed along the heel side 32 of the putter grip 12. By placing the weights along the heal side 32 of the putter grip 12, the putter 10 can be face-balanced as illustrated. That is, the putter 10, when balanced upon a fulcrum 34 will self-orient itself such that the plane defined by the face 28 of the putter head 11 will be substantially perpendicular to the horizon, as represented by the X-Y axis. As such, the entire putter 10 is balanced from heal 26 to toe 24 so as to reduce the disparity of weight distribution between the heel 26 and the toe 24 of the putter head 11 that would otherwise be present when the weight of the head 11 and shaft 13 are combined. Without the weights 30, when the putter 13 is balanced upon a fulcrum 34, the toe 24 of the putter head 11 would be below the longitudinal axis of the putter shaft 13. That is, the putter 13 would rotate from the position shown in FIG. 1 until the putter 10 balanced itself upon the fulcrum 34 with the weight of the putter head 11 causing the putter 10 to rotate about the shaft 13 until the toe 24 of the putter head 11 is downwardly oriented.

In addition, the weights 30 cause the balance point or center of gravity 36 of the putter 10 to be moved, as indicated by the arrow, closer to the grip 12. This significantly increases the "sweet spot" of the putter face so as to provide off center hits from having the same feel and to impart the same force on the golf ball as center hit. This is important for a putter since it is difficult for one to hit the sweet spot of the putter face consistently. Thus, by increasing the sweet spot, off center hits will have the same result. Essentially, the weights 30 can cause the balance point 36 of the putter 10 to be located proximate a midpoint of the putter 10, i.e., approximately half way between the proximal end of the grip 12 and the distal end of the head 11. Moving the center of gravity 36 closer to the grip 12 creates a very different feel for the golfer when putting. In particular, the weights 30 in the grip 12 create a feeling that the putting stroke is maintained at the grip as opposed to a more traditional feeling of swinging the weight that is principally in the head 11. It is well known in the art of proper putting techniques that it is critical during a putting stroke to prevent the leading wrist (i.e., the left wrist for a right-handed putter) from bending during the putting stroke. If the left wrist bends during the putting stroke, any consistency between successive putting strokes will be lost, and will typically result in a put being missed to the left for a right handed putter. The reason that the leading wrist of the golfer often bends during putting is that the opposite hand (which is typically the dominate hand) will overcome the leading hand and cause the wrist to bend. This is often caused by a natural tendency to swing the weight of the putter head through the hitting area. By increasing the weight of the putter at the grip 12, the golfer feels less of the weight of the putter head and more weight in the golfer's hands, reducing the tendency for the dominate hand to overpower the leading hand. In effect, the golfer feels as if the grip of the putter is controlling the putting, as opposed to the head of the putter creating a more stable feeling and more consistent putting.

Figure 2:
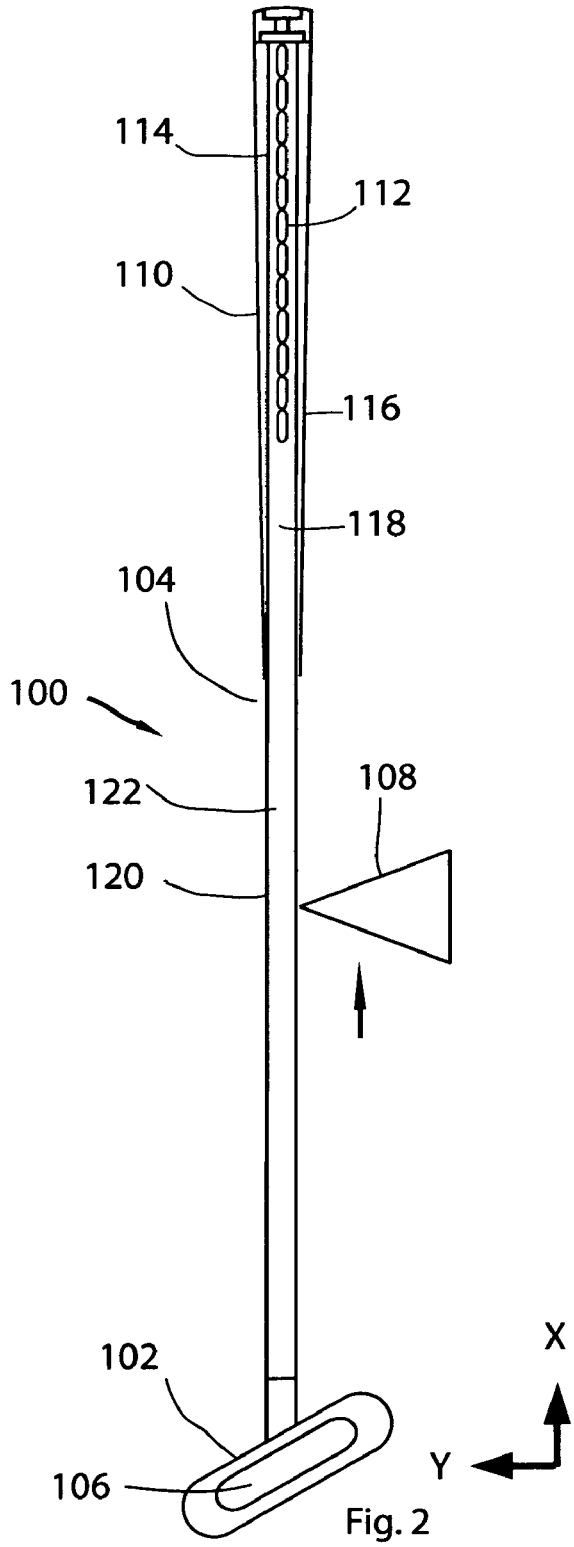
FIG. 2 is a partial cross-sectional side view of another embodiment of a putter grip in accordance with the principles of the present invention attached to a putter.

As shown in FIG. 2, a putter 100 is a putter that is configured to be face-balanced. That is, the head 102 and shaft 104 are configured to cause the face 106 to be substantially vertically oriented as shown when the putter 100 is balanced upon a fulcrum 108. The putter grip 110 of the present invention is thus configured to maintain the face-balanced configuration of the putter 100. As such, a plurality of weights 112 is disposed within the hollow grip member 114 of the putter grip 110 in a manner that does not provide additional weight to the heel side 116 of the putter 100. As illustrated, the weights 112 are disposed along the face side 118 and back side (not visible) of the putter. More specifically, the weights 112 are disposed in line with a center line of the shaft 104 so as to provide equal weight distribution to both the toe side 120 and heel side 116 of the putter 100. As such, the putter head 102 will remain face-balanced with the center of gravity 122 moved closer to the grip 110 for better putting.

Figure 3:
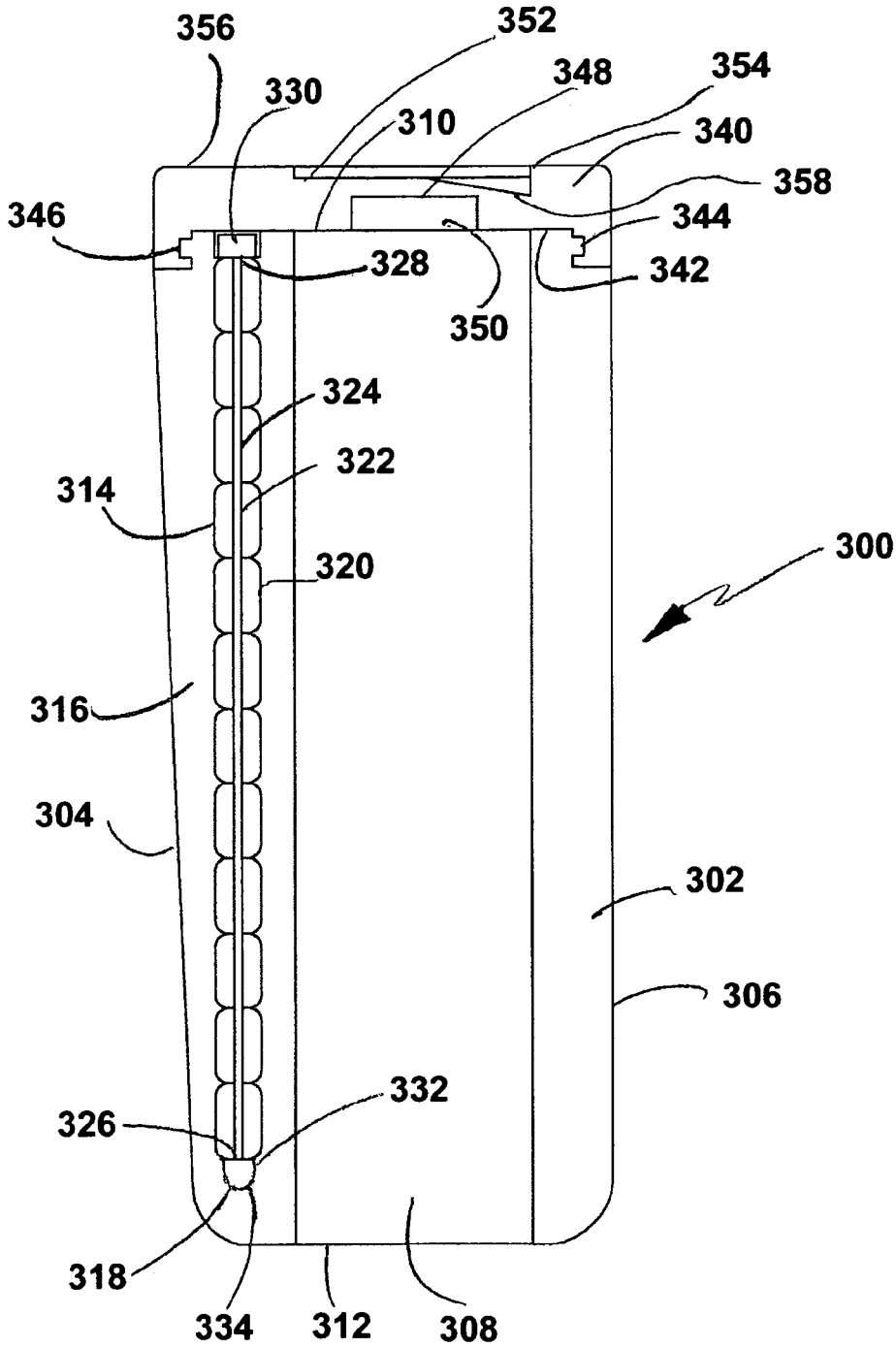
FIG. 3 is a cross-sectional side view of yet another embodiment of a putter grip in accordance with the principles of the present invention.

Referring now to FIG. 3, a putter grip, generally indicated at 300 in accordance with the principles of the present invention is illustrated. The putter grip is shown in exaggerated form to be able to illustrate certain aspects of the invention. In practice, the putter grip is significantly longer than it is wide than what is illustrated in FIG. 3. The putter grip 300 is comprised of an outer sleeve or hollow grip member 302 configured for attaching around the grip end of a putter shaft (not shown). The hollow grip member 302 has a thicker cross-section along the back or heel side 304 of the grip 300 than along the front or toe side 306. Thus, while the hollow grip member 302 is generally cylindrical in nature it has a thin side 306 and a thick side 304. The hollow grip member 302 defines a first longitudinal channel bore 308 extending from a proximal end 310 to a distal end 312. The first longitudinal bore 308 is configured for receiving and attaching to a putter shaft. A second longitudinal channel or bore 314 is defined within a wall 316 of the hollow grip member 302. The second bore 314 extends from the proximal end 310 to a location 318 within the grip member 302. The second channel 314 is configured for receiving a plurality of weighted members 320. The second channel 314 has a cross-section size and shape so as to form a friction fit with the plurality of weighted members 320. Accordingly, the weighted members will not rattle or otherwise cause unwanted vibration relative to the grip when in use. The weighted members 320 are each configured with a central aperture or bore 322 sized for receiving an elongate rod 324. The elongate rod 324 has a first blunt end or nub 332 attached to the distal end 326 of the rod 324. The nub 332 has a diameter greater than the diameter of the bore 322 to retain the weights on the rod 324. At a second end 328 of the rod 324 has a head 330 attached thereto. The head 330 may be configured for being rotated by a hex shaped driver or a flat head or Phillips head screwdriver. The nub 332 is fixedly attached to the distal end 326 of the rod 324 and is positioned when fully inserted at the distal end 334 of the channel 314. As such, the weighted members 320 can be placed on the rod 324 and inserted into the channel 314. The nub 332 and head 330 retain the weighted members 320 on the rod 324 for insertion and removal of the weighted members 320 from the channel 314.

As further illustrated in FIG. 3, an end cap 340 is attached to the proximal end 310 of the hollow grip member 302. The end cap 340 is configured to substantially match the contour of the hollow grip member 302 and to couple thereto. The end cap 340 has an attachment end 342 that defines an internal circumferential groove 344 for receiving an external circumferential protrusion 346 in the distal end 310 of the hollow grip member 302. As such, the end cap is configured to be removeably attached to the distal end 310 of the hollow grip member 302 to allow adjustment of the weighted members 320 by selectively adding or removing weights 320. As such, the grip 300 can be customized for any putter to add or remove weights 320 to face-balance any given putter to which the grip 300 is attached.

The end cap 340 is provided with an internal bottom recess 348 for receiving and securing a magnet 350 therein. The magnet 350 is provided to magnetically hold a ball marker 352 within a top recess 354 formed in the top surface 356 of the end cap 340. The top recess 354 has a shape and size generally configured to match the shape and the size of the ball marker 352 and may be generally cylindrical in shape. The top recess 354 may have an angled portion 358 that is deeper than the rest of the recess 354. When the ball marker 354 is depressed above this angled portion 358, the opposite end of the ball marker will lift above the top surface 356 of the end cap 340 to allow grasping and removal of the ball marker 354.

Figure 4:
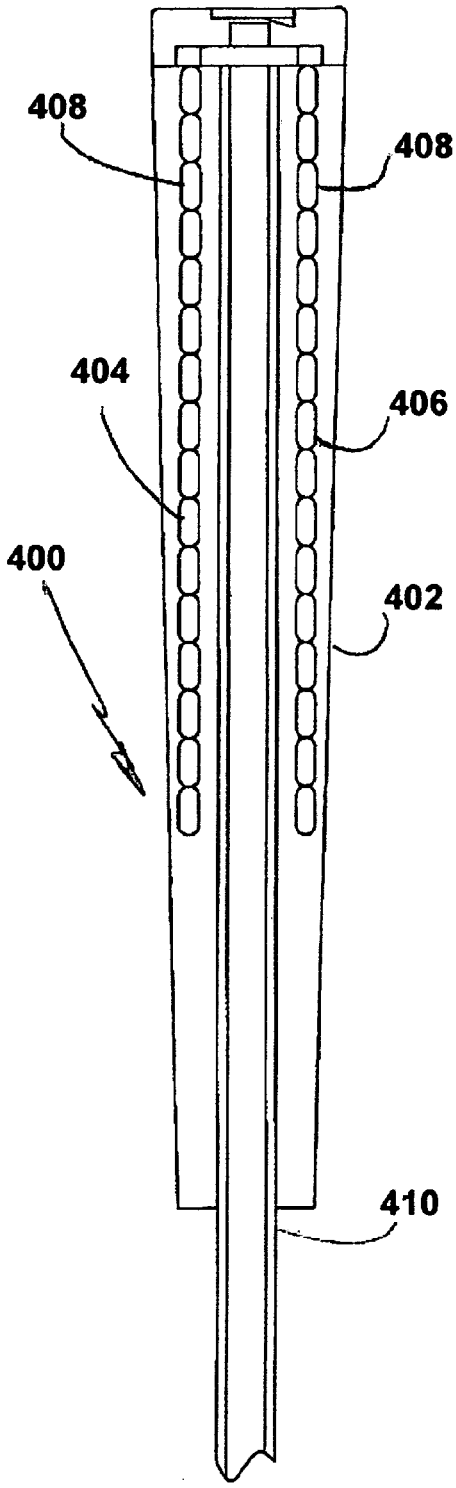
FIG. 4 is a cross-sectional side view of still another embodiment of a putter grip in accordance with the principles of the present invention.

FIG. 4 illustrates another embodiment of a putter grip, generally indicated at 400 in accordance with the principles of the present invention. The putter grip 400 is similar in configuration to the putter grip 300 illustrated with respect to FIG. 3 except that the hollow grip member 402 is provided with a pair of longitudinally extending channels 404 and 406 for receiving and maintaining weight members 408 therein. The channels 404 and 406 are positioned on opposite sides of the putter shaft 410 and may be advantageous for a putter that is already face-balanced. That is, the channels 404 and 406 are in longitudinal alignment relative to the longitudinal axis of the shaft 410 such that the weights 408 do not provide any offset weighting to the putter shaft 410 as previously discussed with reference to FIG. 3. As such, the putter grip 400 provides symmetrical or equal weighting around the putter shaft 410 to maintain the face-balanced characteristics of the existing putter (not shown).

Figure 5:
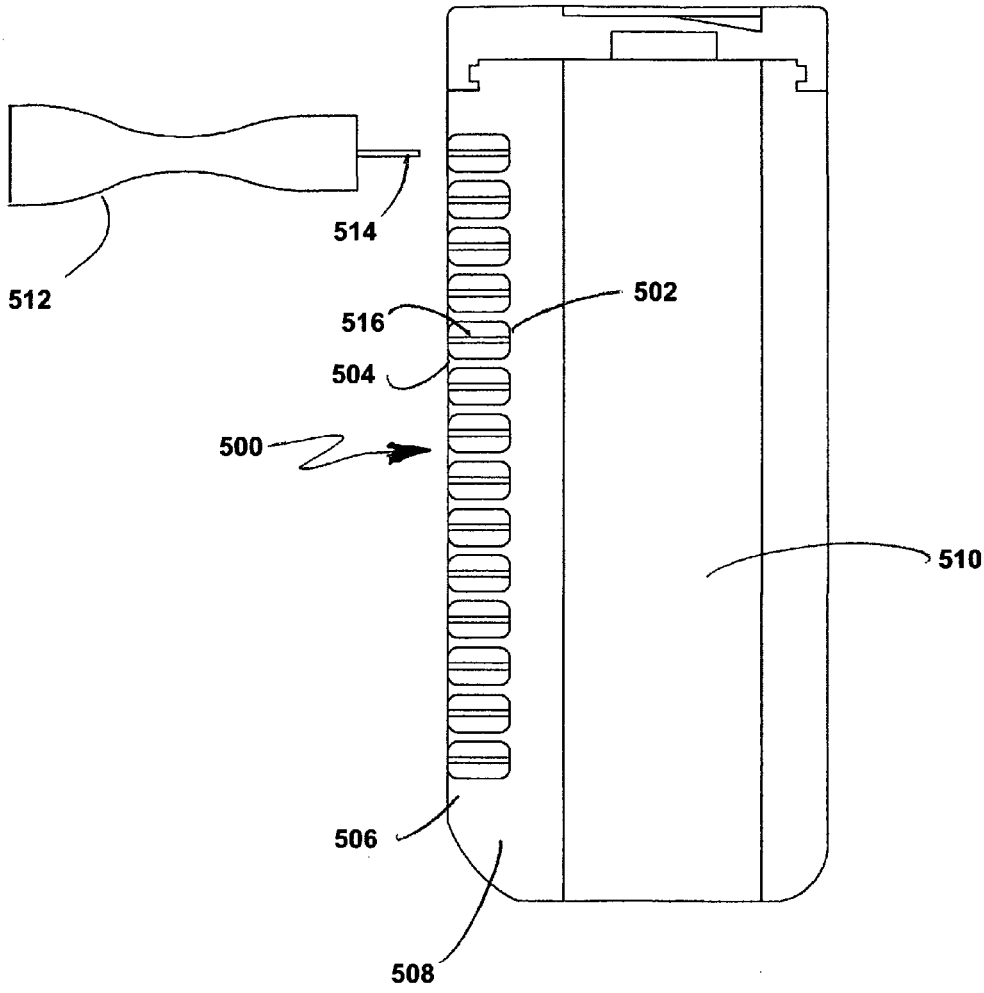
FIG. 5 is a cross-sectional side view of another embodiment of a putter grip in accordance with the principles of the present invention.

As illustrated in FIG. 5, another embodiment of a putter grip 500 in accordance with the present invention is illustrated. The putter grip 500 is configured similarly to the putter grip 300 illustrated in FIG. 3 except that the weighted members 502 are horizontally oriented and held within individual channels 504 formed in the wall 506 of the hollow grip member 508. The channels 504 are thus horizontally oriented in a direction that is substantially perpendicular to the longitudinal axis of the longitudinal bore 510 configured for receiving a putter shaft. The weighted members 502 are selectively insertable and selectively removeable from the hollow grip member 508 as with the tool 512 that has an externally threaded end 514 for engaging an internally threaded bore 516 in each weighted member 502.

Figure 6:
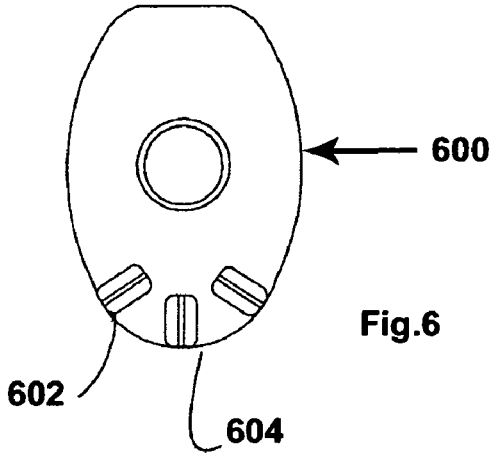
FIG. 6 is a top cross-sectional view of yet another embodiment of a putter grip in accordance with the principles of the present invention.
Figure 7:
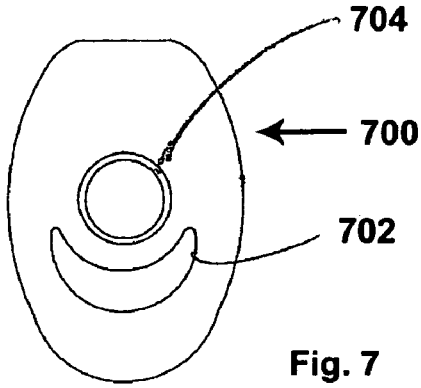
FIG. 7 is a top cross-sectional view of still another embodiment of a putter grip in accordance with the principles of the present invention.
Figure 8:
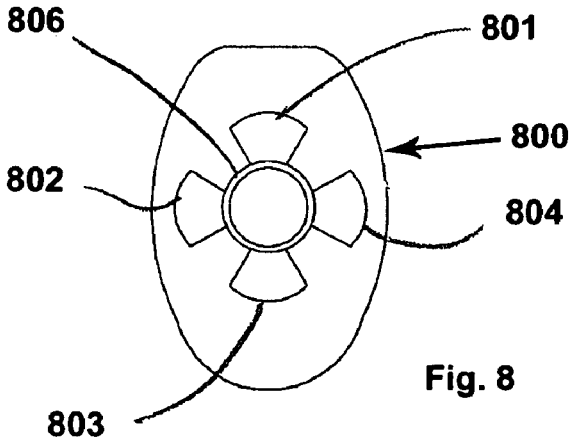
FIG. 8 is a top cross-sectional view of yet another embodiment of a putter grip in accordance with the principles of the present invention.

As illustrated in FIGS. 6, 7 and 8, a putter grip according to the principles of the present invention may have various weighting configurations. In FIG. 6, the putter grip 600 includes a plurality of weighted members 602 that are disposed on the heel side 604 of the grip 600 and attached to the grip 600 in a manner similar to that disclosed with reference to the grip 500 shown in FIG. 5. In FIG. 7, the grip 700 includes a weighted member 702 that has a crescent shaped cross section. Thus the weighted member 702 is contoured to fit around the shaft 704 of the putter (not shown). The weighted member 702 may be of a particular length to provide sufficient weighting to the putter to face-balance the putter. As shown in FIG. 8, the grip 800 is provided with a plurality of wedge-shaped weight members 801-804 that are spaced around the shaft 806 in an equidistant manner such that each weighted member 801-804 is equally radially spaced for a putter that is already face-balanced. Of course, one or more of the weighted members 801-804 could be removed to provide asymmetrical weighting or offset balancing to a non-face-balanced putter to make it face-balanced. Likewise, the weights 801-804 could be rotationally aligned relative to the shaft in different locations.

Figure 9:
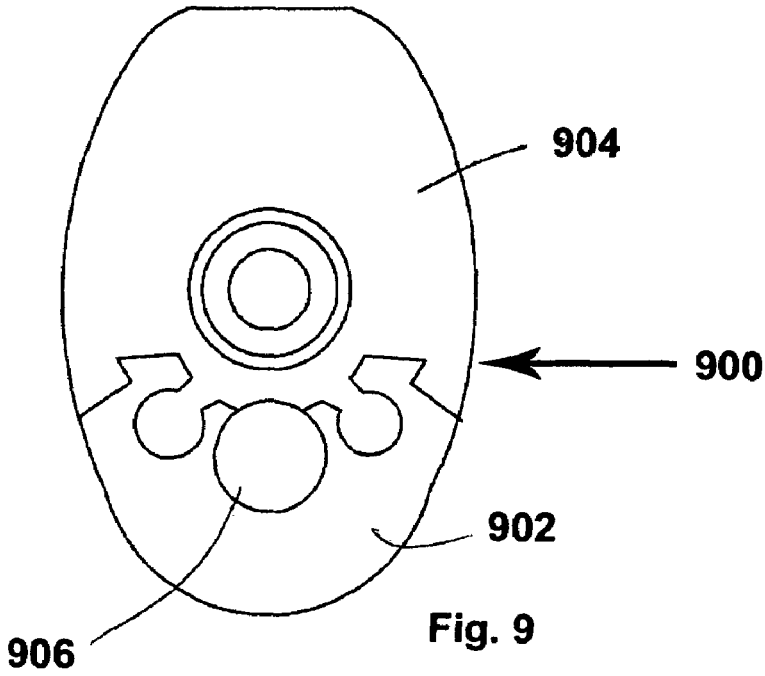
FIG. 9 is a cross-sectional side view of another embodiment of a putter grip in accordance with the principles of the present invention.

As shown in FIG. 9, the putter grip 900 may be a two part construction with a weighted portion 902 and a non-weighted portion 904. The two portions 902 and 904 are interlocked so as to form an integrated putter grip 900. Thus, the two portions 902 and 904 are provided with a plurality of matching and interlocking protrusions and recesses to hold the two portions together once assembled. The weighted member 906 is at least partially embedded within the weighted portion 902 and may comprise an elongate weighted rod formed of steel, tungsten or other materials known in the art.

Figure 10:
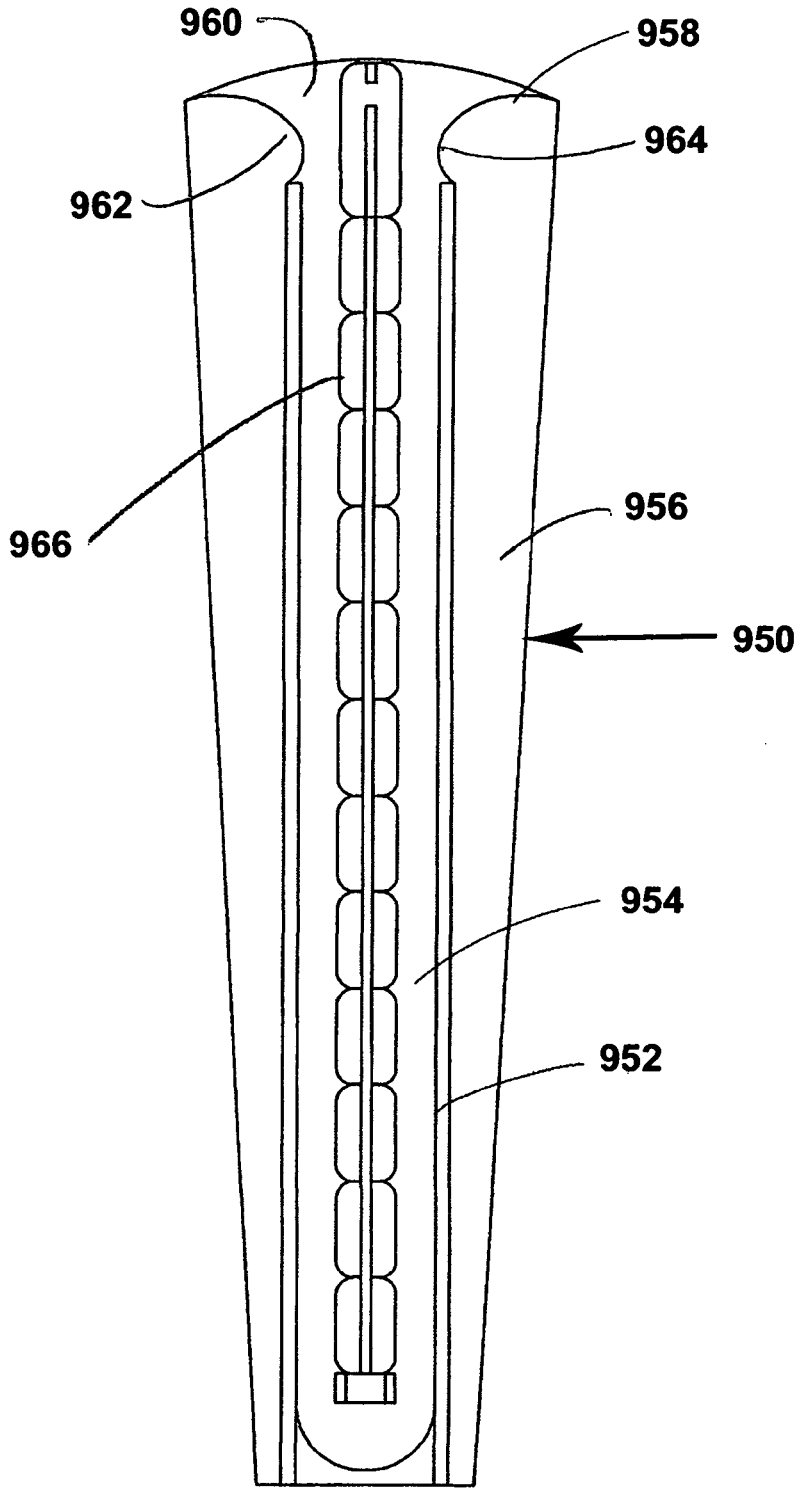
FIG. 10 is a top cross-sectional view of yet another embodiment of a putter grip in accordance with the principles of the present invention.

As shown in FIG. 10, it may be desirable to provide weight within the shaft 952 of a putter by providing a weighted shaft insert portion 954 incorporated into a putter grip 950. The putter grip 950 thus includes an inner portion 954 for at least partial insertion into the shaft 952 of the putter and an outer grip portion 956 that extends around the shaft 952 of the putter in a traditional manner. The proximal ends 958 and 960 of the grip portions 956 and 954, respectively, are configured to mate with the inner grip portion 954 forming a circumferential recess 962 and the outer grip portion 956 forming an inner circumferential protrusion. The inner portion 954 is provided with a plurality of weight members in a configuration similar to the weighted members illustrated in FIG. 3.

Figure 11:
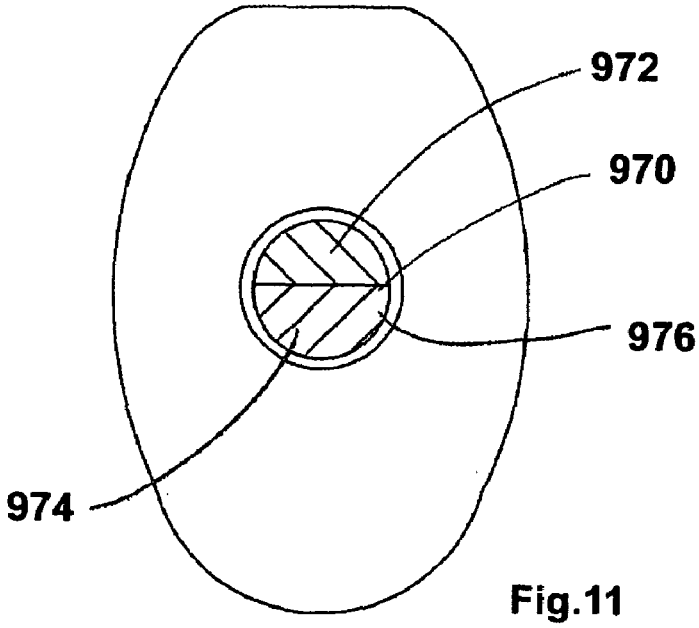
FIG. 11 is a top cross-sectional view of still another embodiment of a putter grip in accordance with the principles of the present invention.

As illustrated in FIG. 11, it may be desirable to provide asymmetrical or offset weighting to the grip end of the putter by providing a shaft insert 970 that is not equally weighted according to the principles of the present invention. That is, the insert 970 has a first portion 972 that takes up space within the inside longitudinal bore 976 defined by the shaft 970 while not adding significant weight while the second portion 976 is significantly weighted as by providing a semi-cylindrical section of tungsten to provide substantial weight to one side of the shaft 970. The lightweight portion 972 may be comprised of plastic, foam rubber, aluminum, air or other materials known in the art. The lightweight and weighted portions 972 and 974 together form a cylindrically shaped member that may have different lengths depending upon the desired weighting. Also, while illustrated as being approximately equal in volume (i.e. 1:1), the portions 972 and 974 could occupy different volumes so as to be in the ratio of 1:2, 2:1, 1:3, 3:1, 1:4, 4:1, etc. It is noted that the weighting of the inside of the shaft 970 may be incorporated with other weighting configurations illustrated herein. For example, to provide additional weight to the putter grip illustrated in FIG. 1, the shaft could also be weighted as described herein.

Figure 11A:
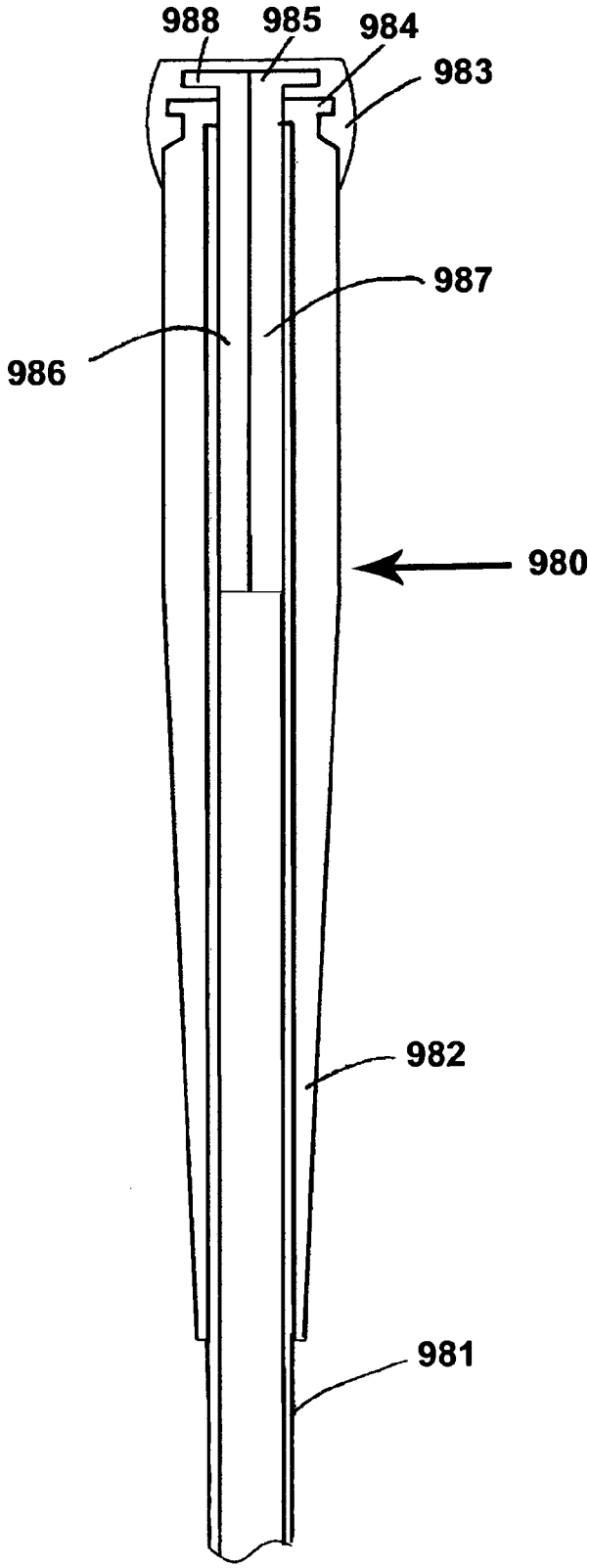
FIG. 11A is a side cross-sectional view of an embodiment of a golf club grip in accordance with the principles of the present invention.

As further illustrated in FIG. 11A, the grip 980 is configured to weight the center of the shaft 981. The grip 980 is comprised of a hollow grip member 982 sized to receive the shaft 981 therein, an end cap 983 rotatably mounted to the proximal end 984 of the hollow grip member 982 and an elongate weight 985 disposed at least partially within the center of the shaft 981 fixedly attached to the cap 983 and rotatable within the shaft 981. The proximal end 988 of the weight 985 may be wider than the rest of the weight 985 and embedded within the end cap 983. By providing a non-circular shape, such as hexagonal, to the distal end 988 of the weight, the weight cannot rotate relative to the end cap and thus will rotate with the end cap 983 upon rotation of the end cap. The weight 985 is comprised of a heavy portion 986 and a lightweight portion 987. By rotating the cap 983 relative to the grip member 982, the rotational position of the weight 985 to the shaft 981 can be selectively changed. Thus, a user can add more weight to one side of the shaft simply by rotating the end cap 983 relative to the hollow grip member 982. In addition, positional markings (not shown) can be provided on the hollow grip member along with an alignment marking on the cap 985 to show the position of the weighted side relative to the shaft in any given cap position.

Figure 12:
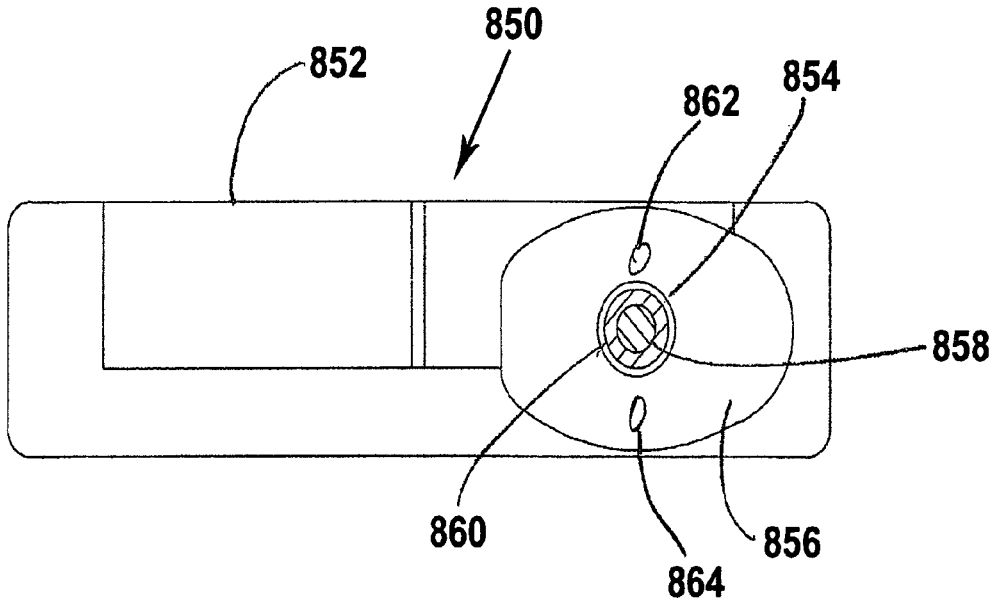
FIG. 12 is a partial top cross-sectional view of yet another embodiment of a putter grip in accordance with the principles of the present invention.

Thus, as shown in FIG. 12, a putter 850 is provided with a putter head 852 to which a shaft 854 and a weighted grip 856 according to the present invention are attached. The shaft 854 is internally weighted with a weight member 858 held within the shaft with a weight support structure 860 that may be in the form of a sleeve capable of securing to the inside surface of the shaft 854. Weights 862 and 864 are also provided within the grip 856 in a manner consistent with the principles of the present invention. As such, it is contemplated that a combination of weighting of the shaft and grip may provide advantageous results for face balancing and grip weighting to create the optimum weighting for the grip end of the putter 850.

Figure 13:
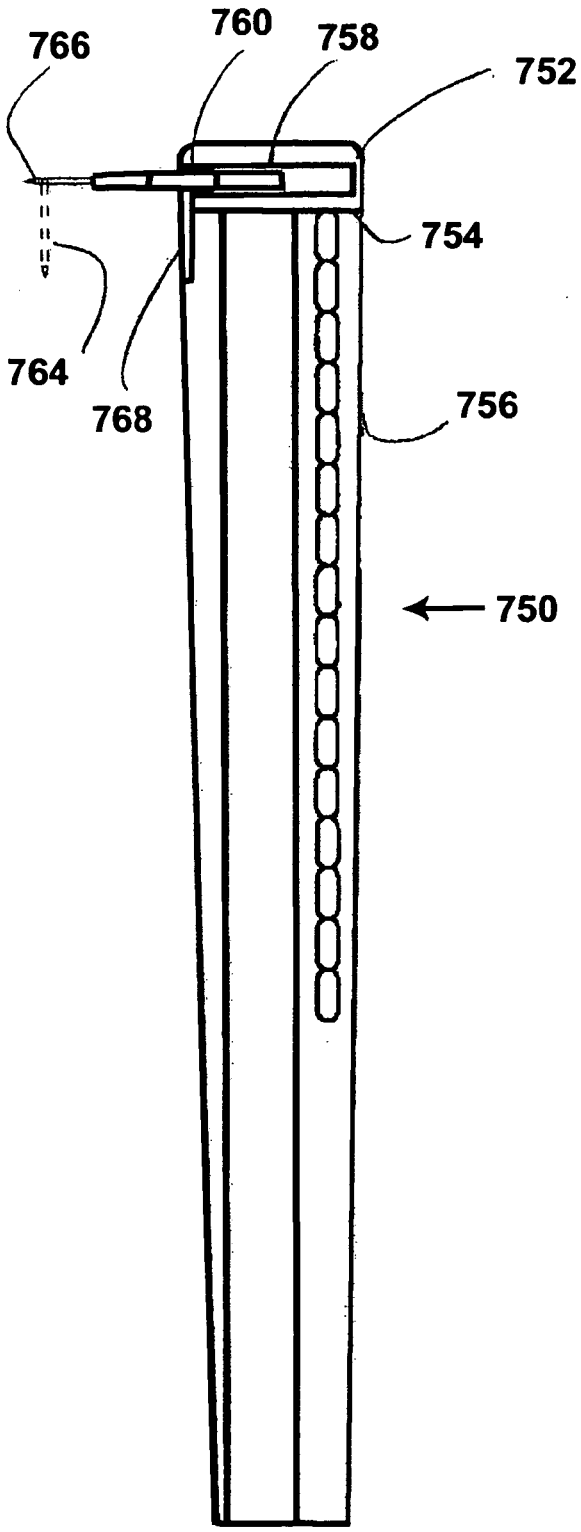
FIG. 13 is a cross-sectional side view of still another embodiment of a putter grip in accordance with the principles of the present invention.

As shown in FIG. 13, a putter grip 750 according to the present invention includes an end cap 752 configured for attachment to the proximal end 754 of the hollow grip member 756 according to the present invention. The end cap 752 defines a transverse channel or bore 758 for housing a telescopic alignment aid 760. The telescopic alignment aid 760 is retractable within and extendable from the bore 758. A perpendicularly extending arm 764 is attached to the distal end 766 of the telescopic alignment aid 760. The arm 764 can be rotated relative to the telescopic member 760 by rotating the arm 764. In use, the arm 764 would be rotated from the vertical position as shown to a substantially horizontal position. To store the telescopic alignment aid 760 within the cap 752, the alignment aid 760 is collapsed into the end cap 752 and the arm is forced into the longitudinal recess 768 formed in the hollow grip member 756.

Figure 14:
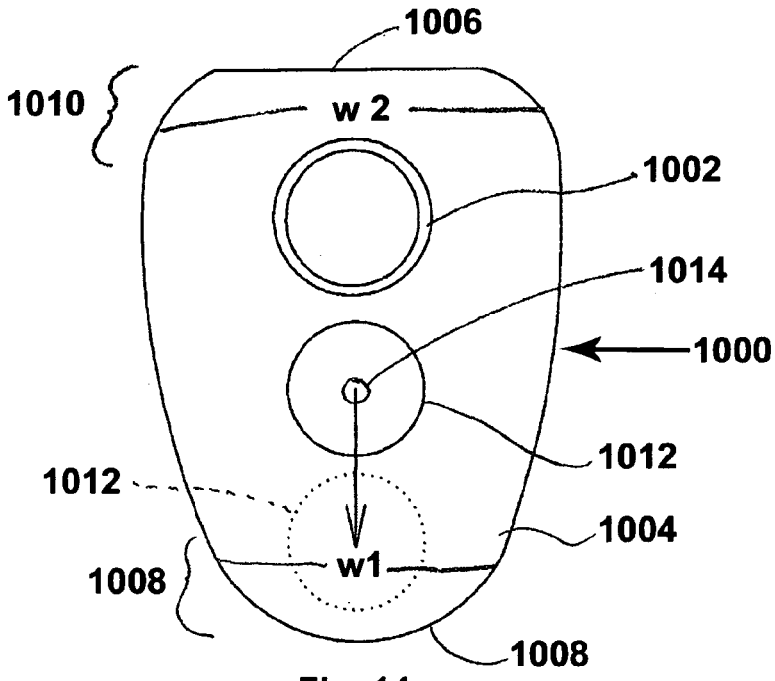
FIG. 14 is a cross-sectional top view of another embodiment of a putter grip in accordance with the principles of the present invention.

Referring now to FIG. 14, there is shown another embodiment of a putter grip, generally indicated at 1000. The putter grip is positioned around a putter shaft 1002. The putter shaft 1002 is positioned forward of the longitudinal center line of the hollow grip member 1004. The cross-sectional configuration of the grip is such that the front surface 1006 is substantially and relatively flat, whereas the rear surface 1008 is generally curved and configured to be wrapped by the fingers. Thus the width W1 of the rear portion 1008 is more narrow than the width W2 of the front portion 1010. This narrowing from the front to the back allows the hands and fingers to grasp the grip 1000 in a natural yet proper putting grip manner.

The grip 1000 has a depth from the front surface 1006 to the rear surface at its widest point of approximately 1.75 inches with the widest part of the grip between W1 and W2 of approximately one inch. The grip 1000 may have an overall length of approximately 10 to 11 inches with a desired length of about 10.25 inches. Also, because of its relative oversized nature, the shaft 1002 can be positioned closer to the front surface 1006 than the rear surface 1008 which allows for the insertion of a weight 1012. Depending upon the desired overall weight and the potential desire to face balance a putter face without using excessive weight, the weight 1012 may be positioned closer to the shaft 1002 as represented in solid lines or closer to the rear surface 1008 as represented by dotted lines. A desired weight may be approximately 8 ounces for a typical putter. This may be accomplished by using approximately ¾ to ⅜ ounce tungsten weights and/or ½ ounce tungsten weights. In addition, it may be desirable to provide weights of varying weight within the same putter grip. For example, the ¾ ounce weights could be placed closer to the proximal end of the putter grip with the ⅜ ounce weights positioned closer to the distal end of the putter grip such that the grip is actually heavier nearer the top or proximal end of the putter grip. This may also help to provide weights along substantially the entire length of the putter grip as the putter grip narrows from the proximal to distal end by using smaller weights where the grip narrows. The grip 1000 includes an air hole 1014 to allow air to flow out of the grip 1000 when the weight 1012 is inserted into the grip 1000. An air hole may also be provided on the bottom end of the grip that is in communication with the weight receiving channel to allow air to flow in and out of the grip as the snug fitting weight is inserted or removed.

Figure 15:
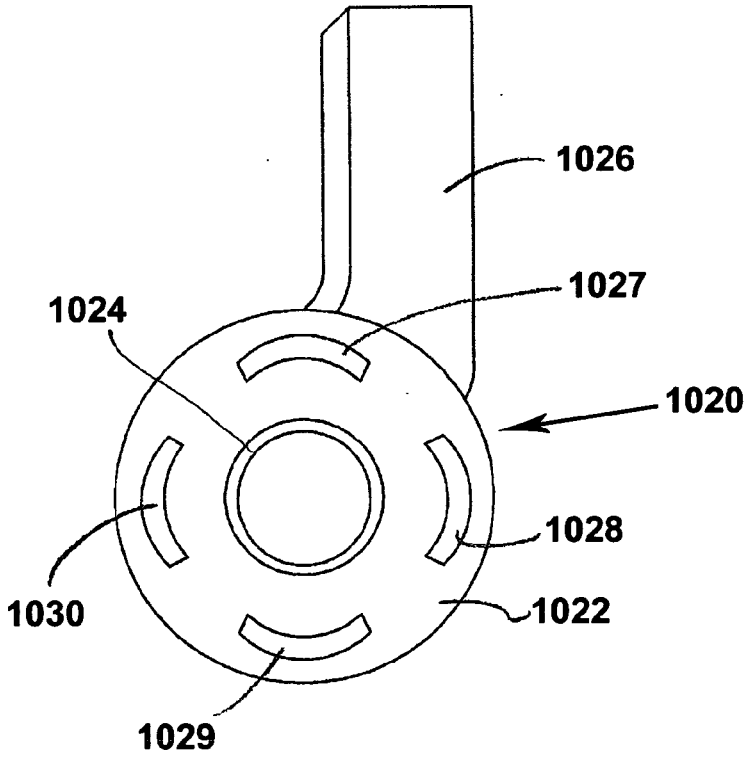
FIG. 15 is a partial cross-sectional top view of an embodiment of a golf club grip in accordance with the principles of the present invention.

Those of skill in the art will appreciate that it may be desirable to provide a weighted grip to other golf clubs, including but not limited to irons and drivers. As shown in FIG. 15, a weighted iron grip 1020 is illustrated. The hollow grip member 1022 is attached to the shaft 1024 of the iron 1026. In order to provide equal weighting around the perimeter of the shaft 1024, a plurality of evenly spaced and weighted weights 1027-1030 are inserted into the body of the hollow grip member 1022 between its inner and outer surfaces. Of course, if desired, the weights 1027-1030 could be configured so as to provide uneven weighting to the hollow grip member 1022 to change the feel of the golf club and to provide correction for slicing and/or hooking, and/or to make adjustments to lessen the effective swing weight of the club.

Figure 16:
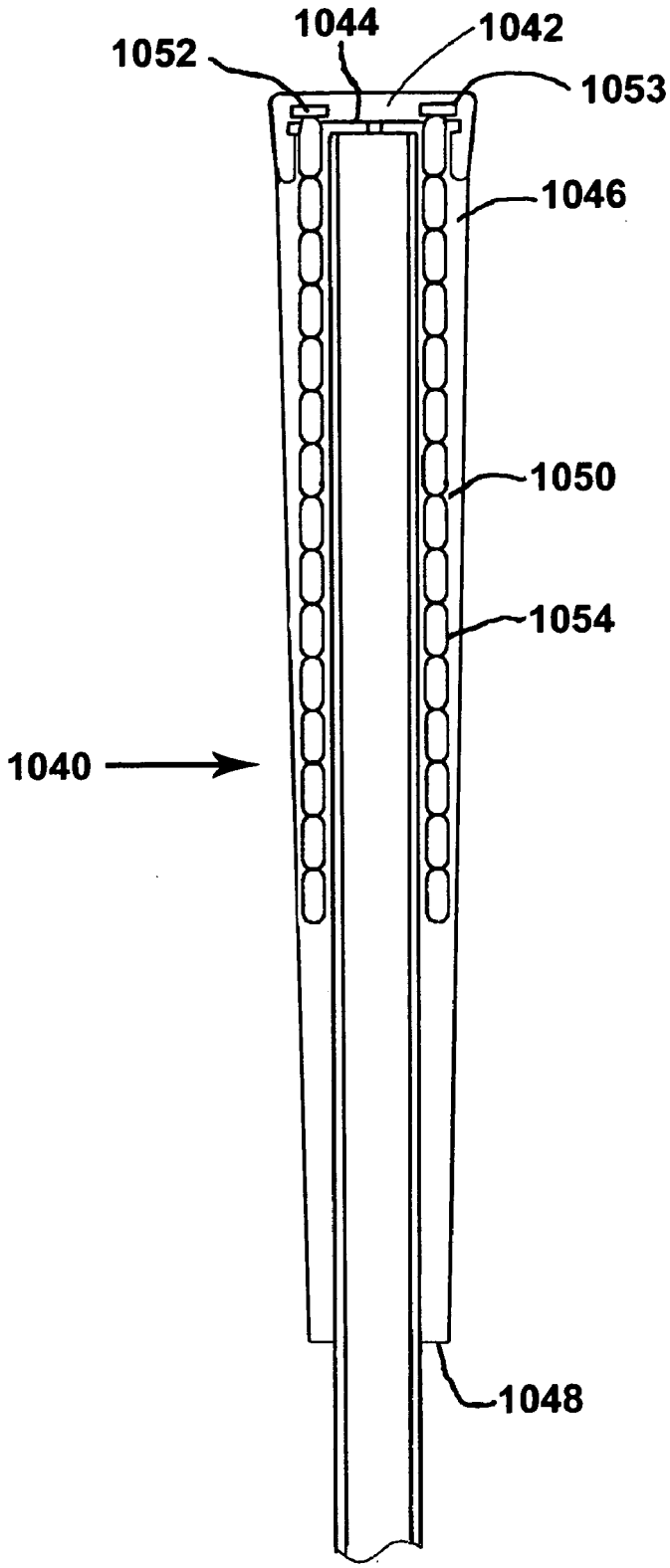
FIG. 16 is a cross-sectional side view of another embodiment of a golf club grip in accordance with the principles of the present invention.

As shown in FIG. 16, a golf grip 1040 is illustrated. The grip 1040 includes an end cap 1042 that fits over the proximal end 1044 of the hollow grip member 1046. The grip 1040 is tapered from the proximal end 1044 to the distal end 1048. The weights 1050 are attached to threaded rods 1052 and 1053 for insertion and removal. The weights 1050 may be internally threaded or provided with a single threaded weight or nut 1054 attached to the distal end of the rod 1053 for insertion and removal of the weights 1050.

Figure 17A:
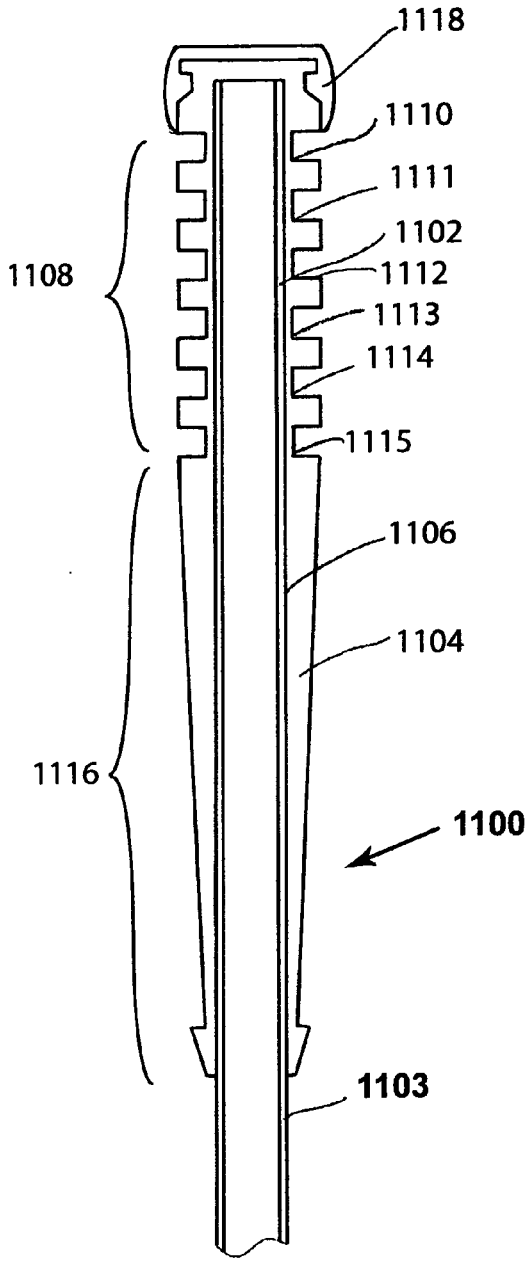
FIG. 17A is a cross-sectional side view of yet another embodiment of a golf club grip in accordance with the principles of the present invention.
Figure 17B:
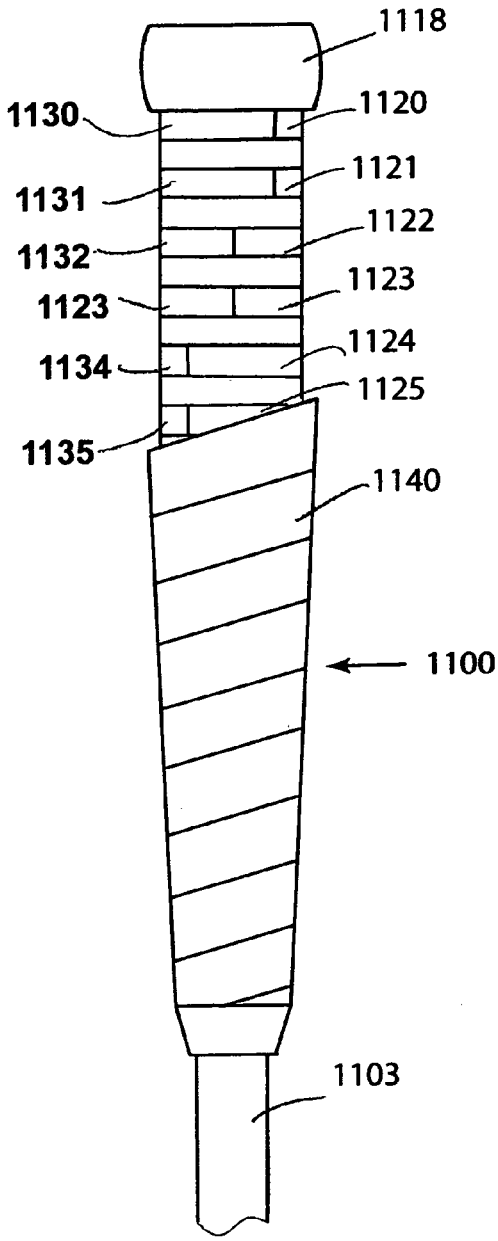
FIG. 17B is a side view of the golf club grip illustrated in 17A in a partially assembled form.

As further illustrated in FIG. 17A, a golf grip 1100 in accordance with the principles of the present invention is illustrated. The golf grip 1100 is attached to the proximal end 1102 of a shaft 1103 of a golf club. The grip 1100 is comprised of an inner elongate hollow member 1104 having an inner elongate channel 1106 sized to snugly fit over the shaft 1103. An upper portion 1108 of the inner hollow member 1104 defines a plurality of circumferential channels or grooves 1110-1115. The grooves 1110-1115 are sized to receive partially ring-shaped weighted members and spacers. The lower portion 1116 of the hollow member 1104 is configured in a conventional manner to allow a leather or other material wrap around the grip as shown in FIG. 17B. A cap 1118 of attached to the distal end of the hollow grip member 1104.

As shown in FIG. 17B, a plurality of partial ring-shaped weighted members 1120-1125, having a generally cylindrical shape are disposed within the grooves 1110-1115. In addition, partial ring-shaped spacers 1130-1135 are also positioned within the grooves 1110-1115. The combination of weighted members 1120-1125 and corresponding spacers 1120-1125 substantially completely fill each groove 1110-1115. The weighted members 1120-1125 may be positioned on one side of the grip 1100 to create a weighted grip 1100 that is unbalanced relative to the longitudinal axis of the shaft 1103. Likewise, the weighted members 1120-1125 may be evenly distributed around the shaft 1103 so as to create an even weight distribution around the shaft 1103 so as to provide a weighted grip that is evenly balanced relative to the longitudinal axis of the shaft 1103.

Once the desired weight distribution has been achieved, the grip 1100 is wrapped with a leather or synthetic wrap 1140 commonly used in the golf industry. While only partially shown in wrapped form, the wrap 1140 would extend along the length of the grip to the cap 1118. To reposition the weights as desired, the wrap 1140 is unwound, and the weights can be easily repositioned. The wrap 1140 would then be reapplied to cover the weights.

Figure 18:
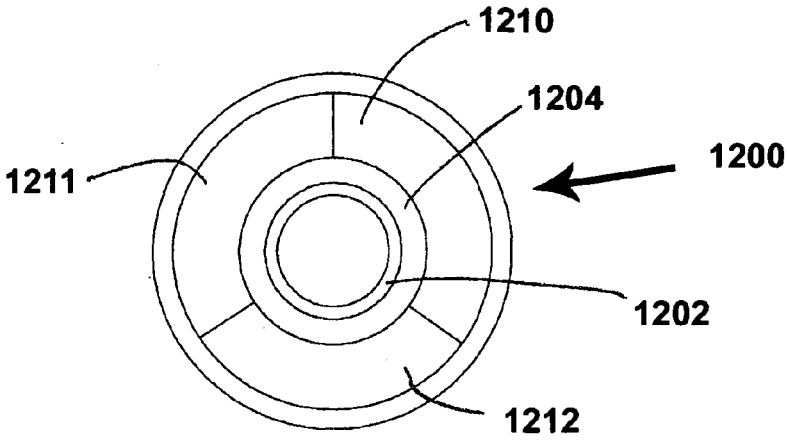
FIG. 18 is a top view of another embodiment of a golf club grip in accordance with the principles of the present invention.
Figure 19:
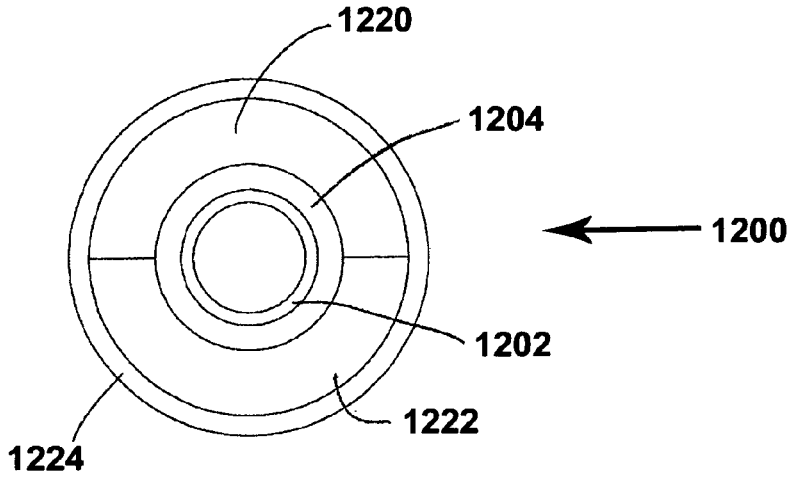
FIG. 19 is a top view of yet another embodiment of a golf club grip in accordance with the principles of the present invention.
Figure 20:
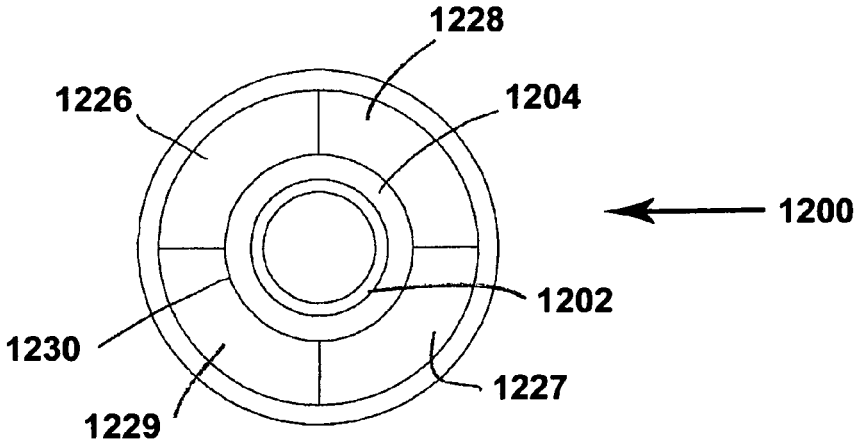
FIG. 20 is a top view of another embodiment of a golf club grip in accordance with the principles of the present invention.

Referring now to FIGS. 18, 19 and 20, a golf grip 1200 in accordance with the principles of the present invention is configured for attachment to the shaft 1202 of a golf club. The golf grip 1200 is comprised of an inner hollow grip member 1204 sized to snugly fit over the shaft 1202. The hollow grip member 1204 is configured similarly to the hollow grip member 1104 illustrated in FIG. 17A. In FIG. 18, ring-shaped weight members 1210-1212 each occupy approximately ⅓ of the space in each groove. The weights 1210-1212 may be comprised of tungsten carbide, steel, lead or other heavy materials known in the art. As shown in FIG. 18, the weights are evenly distributed around the shaft 1202 in a concentric manner. In order to create an asymmetrical weight distribution around the shaft 1202, some of the weights 1210-1212 may be replaced with lightweight spacers of similar size and shape. Thus, for example, to provide additional weight to once side of the grip 1200, the weights 1211 and 1212 may be replaced with plastic, aluminum or other lightweight spacers, such that the weight 1210 provides weighting to its respective side of the shaft 1202. In addition, each groove as shown in FIG. 17A could be provided with a similar weight/spacer arrangement so as to provide weighting along one side of the grip 1200 along the upper portion of the grip 1200. Likewise, the grip 1200 can be customized such that certain grooves may contain weights while others only contain spacers to allow for customizable weighting of the grip incrementally as desired by adding more or less weights.

Similarly, as shown in FIG. 19, the grip 1200 is provided with semicircular weights 1220 and spacers 1222 so as to provide weighting along one side of the shaft 1202. The weights 1220, spacers 1222 and hollow grip member 1204 are covered by an exterior sleeve or wrap 1224. In FIG. 20, the weights 1226, 1227 and spacers 1228, 1229 each occupy one quarter of the groove 1230 to allow a plurality of combinations of weights and spacers around the shaft 1202.

Figure 21:
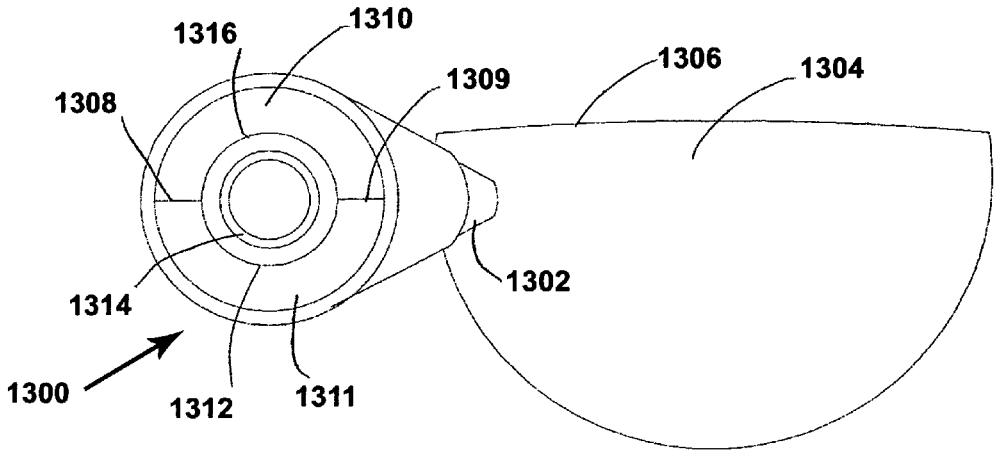
FIG. 21 is a top perspective view of an embodiment of a golf club having a grip according to the present invention attached thereto.

FIG. 21 is a top perspective view of a putter grip 1300 attached to the shaft 1302 of a golf club 1304 (a driver in this exemplary embodiment). The grip 1300 is configured similarly to the grip 1200 shown in FIG. 19 and is oriented relative to the face 1306 of the golf club 1204 so that the dividing lines 1308 and 1309 between the weight or spacer 1310 and the weight or spacer 1311 are substantially parallel to the face 1306.

It has been discovered during the course of developing the weighted grips of the present invention that providing weighting along various sides of the grip has an affect on the trajectory of a golf ball hit with a club 1304 utilizing such a grip 1300. That is, by providing a weight 1311 along the back side 1312 of the shaft 1314 and a lightweight spacer 1310 along the front side 1316 of the shaft 1314, a fade is promoted (i.e., a golf ball flight pattern that drifts from left to right for a right-handed golfer). Conversely, by providing a weight 1310 on the face side 1316 of the shaft 1314, a draw is promoted (i.e., a golf ball flight pattern that drifts from right to left). Thus, the golfer can tailor the weights to square-balance the club face so as to be more open or closed at impact. In addition, the weight in the grip 1300, regardless of its position, promotes a later release of the golf club which substantially reduces the possibility of a hook (i.e., a ball flight trajectory that moves severely from right to left for a right-handed golfer). As such, by adding weight to various sides of the golf grip 1300, a golfer can modify the flight path of a golf ball hit with a golf club having a weighted grip according to the principles of the present invention. For a golfer that typically slices the ball, adding weight to the face side of the shaft will promote a straighter golf shot that moves less from left to right or that actually moves from right to left. Likewise, for a golfer that hooks the ball, weight can be added to the back side of the shaft to promote straighter golf shots. By positioning weight as herein described along one side of the shaft of a golf club, such as a driver, the weight imparts a moment of inertia on the shaft of the golf club to cause a golfer to close the club face more rapidly during a golf swing for a right handed golfer with the face side of the shaft being weighted. Conversely, by placing the weights along the back side of the shaft, a later release of the head of the golf club is promoted to cause the face to remain open longer during a golf swing. Thus, for a golfer who typically hits a hook, weighting the back side of the shaft will cause a later release of the golf club and thus a squaring of the face at impact, as opposed to a closed face that would otherwise result in a hooked golf shot. Moreover, by placing weight in the grip of a golf club, the effective swing weight of the club is changed so as to produce a lighter swing weight. The swing-weight of a club is the balance of the overall weight of the club and is the measurement of clubs balanced at the 14 inch fulcrum and is an industry standard. Swing weights range from A-0 to G-2. The higher the swing-weight the more the weight is distributed towards the club end and vice versa. Standard swing-weight for men is D-0 to D-2 and for women it is C-7 to C-9. The basic swing-weight rules are as follows: every 2 grams added to head weight=1 s/w; every 7 grams of shaft weight=1 s/w; every 4 grams of grip weight=1 s/w; every ½ inch over length=3 s/w. To increase swing-weight, either 1) lengthen the club, 2) add weight to the head, or 3) use a heavier shaft. To decrease swing-weight, either 1) shorten the club, 2) add weight to the grip according to the present invention, or 3) use a lighter shaft. The present invention results in clubs that can be in the A or low B swing weight range. According to the present invention, a swing weight of between A-7 and A-9 is beneficial and a swing weight of approximately A-8 has been found to be particularly beneficial. Thus, for a driver having a standard D-2 swing weight, approximately 96 grams of weight would need to be added to the grip according to the present invention in order to attain an A-8 swing weight.

By placing more of the weight of the club in the hands of the golfer, the golfer has a better feel for hand position throughout the swing resulting in more control of the club during a golf swing and thus straighter golf shots. This added control is provided with the weighted golf grip of the present invention regardless of whether the grip is offset weighted on any side of the grip.

While this invention has been described in certain embodiments, the present invention can be further modified with the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A golf grip, comprising:

a hollow grip member defining a longitudinal channel for receiving a putter shaft and a second longitudinal channel disposed within in a wall of said hollow grip member;

a plurality of weighted members disposed within said second longitudinal channel, said plurality of weighted members weighting one side of said hollow grip member, said plurality of weighted members being selectively removable relative to said hollow grip member wherein the second longitudinal channel has an opening at a proximal end of said hollow grip member for receiving said plurality of weighted members therein; an elongated rod having a nub attached to a first end and a head attached to a second end, the plurality of weighted members each having an aperture for receiving and being disposed on said elongated rod and being retained on said elongated rod by said nub; and a cap member attached to a proximal end of said hollow grip member.

* * * * *